US005492107A

United States Patent [19]

Furuya

[11] Patent Number: 5,492,107

[45] Date of Patent: Feb. 20, 1996

[54] AIR FUEL RATIO CONTROL APPARATUS FOR AN INTERNAL COMBUSTION ENGINE

[75] Inventor: Junichi Furuya, Atsugi, Japan

[73] Assignee: Unisia Jecs Corporation, Atsugi, Japan

[21] Appl. No.: 366,436

[22] Filed: Dec. 30, 1994

Related U.S. Application Data

[63] Continuation of Ser. No. 92,810, Jul. 19, 1993, abandoned.

[30] Foreign Application Priority Data

Jul. 17, 1992 [JP] Japan ..... 4-191042

[51] Int. Cl.[6] ..... F02D 41/14

[52] U.S. Cl. ..... 123/686

[58] Field of Search ..... 123/686, 685

[56] References Cited

U.S. PATENT DOCUMENTS 4,475,517 10/1984 Kobayashi et al. ..... 123/686
4,721,088 1/1988 Mieno et al. ..... 123/686
4,763,628 8/1988 Mieno et al. ..... 123/686

FOREIGN PATENT DOCUMENTS 60-240840 11/1985 Japan .
61-31633 2/1986 Japan ..... 123/685
1-301939 12/1989 Japan ..... 123/686

*Primary Examiner*—Andrew M. Dolinar
*Attorney, Agent, or Firm*—Foley & Lardner

[57] ABSTRACT

An air-fuel ratio feedback correction coefficient is controlled proportionally and integrally based on the oxygen density of the exhaust gas as detected by an oxygen sensor. The oxygen sensor has decreased response characteristics at low temperatures. When the ignition switch is switched on, a heater in the oxygen sensor is turned on and an initial value KLMDø of a correction value is set based on engine water temperature Tw. The initial value is in turn gradually increased over time and converges to 1.0. Excessive control amplitudes during cold engine starting are thus avoided by compensation for the oxygen sensor temperature condition.

4 Claims, 6 Drawing Sheets

AIR FUEL RATIO CONTROL APPARATUS FOR AN INTERNAL COMBUSTION ENGINE

This application is a continuation of application Ser. No. 08/092,810, filed Jul. 19, 1993, now abandoned.

BACKGROUND OF THE INVENTION

The instant invention is directed to an air-fuel ratio control apparatus for internal combustion engines; more particularly, to an apparatus which uses feedback to control the air-fuel ratio of an engine intake mixture to a target air-fuel ratio.

Japanese First Publication No. 60-240840, published Nov. 29, 1985, describes a conventional air-fuel ratio control apparatus. This conventional apparatus is provided with an oxygen sensor to detect the oxygen density in the exhaust gas, which is representative of the air-fuel ratio of the engine intake mixture, to set an air-fuel ratio feedback correction coefficient. Proportional-integral control is performed based on a comparison of the signal from the oxygen sensor with a level equivalent to the stoichiometric air-fuel ratio, that is, the target air-fuel ratio.

In a conventional system, during cold starting the response characteristics for oxygen density detection degrade due to the low temperature of the oxygen sensor. Therefore, an excessively large control amount for air-fuel ratio feedback control during cold starting makes it difficult to stabilize the air-fuel ratio around the stoichiometric value that results in the best conversion rate for a three-way emissions-control catalyst, even if the catalyst reaches an active state as early as possible as a result of heating by a heater. In this situation, exhaust emission purification is inefficient.

In another conventional apparatus a heater is attached to the oxygen sensor to heat the sensor element in order to activate the oxygen sensor as early as possible. This heater is provided with power in response to ignition switch operation so that the sensor is heated during the non-revolution state of the engine.

The temperature of the oxygen sensor without a heater generally varies with engine temperature. On the other hand, the temperature of the oxygen sensor with a heater varies with heater operating time as well as with engine temperature, which in turn causes variation in the control characteristics, i.e., the amplitude for air-fuel ratio feedback control.

SUMMARY OF THE INVENTION

The instant invention has been developed with the foregoing problems in mind. An object of the invention is to provide an apparatus for controlling the air-fuel ratio which ensures that the control amount for air-fuel ratio control is sufficiently small during cold engine starting without any of the adverse effects associated with providing power to the heater attached to the sensor detecting the air-fuel ratio.

According to a first aspect of the invention, there is provided an air-fuel ratio control apparatus to control the air-fuel ratio of an internal combustion engine. The control apparatus includes an air-fuel ratio sensor to produce a signal representative of the air-fuel ratio of the engine. The air-fuel ratio sensor has temperature variant output characteristics. An assembly varies the amount of fuel delivered to the engine. An engine temperature detector produces an engine temperature signal representative of the temperature of the engine and an engine start detector produces an engine start signal representative of the starting of the engine. A control amount correction unit receives the engine temperature signal and the engine start signal and outputs control signals to the assembly which are compensated for the temperature variant output characteristics based on engine temperature and the time elapsed since the starting of the engine.

According to another aspect of the invention, there is provided an air-fuel ratio control apparatus for an internal combustion engine. The control apparatus includes an air-fuel ratio sensor having an output which varies in accordance with the density of a specific component in the exhaust gas which is representative of the air-fuel ratio of the engine intake mixture. A control value setting unit sets a control value to control the air-fuel ratio of the engine intake mixture to a target air-fuel ratio based on an output of the air-fuel ratio sensor. An air-fuel ratio control unit controls the air-fuel ratio of the engine intake mixture in response to the control value set by the control value setting unit. An engine temperature detector detects the engine temperature and an engine start detector detects the engine start condition. The control amount correction unit corrects the control amount of the control value of the control value setting unit using the engine temperature detected by the engine temperature detector and an elapsed time since engine starting as detected by the engine start detector.

Other objects, features, and advantages of the invention will be apparent from the detailed description of preferred embodiments set forth below.

BRIEF DESCRIPTION OF THE DRAWINGS

Preferred embodiments of the invention will be described in detail below with reference to the accompanying drawings, wherein.

DETAILED DESCRIPTION OF THE PREFERRED EMBODIMENTS

Figure 1:
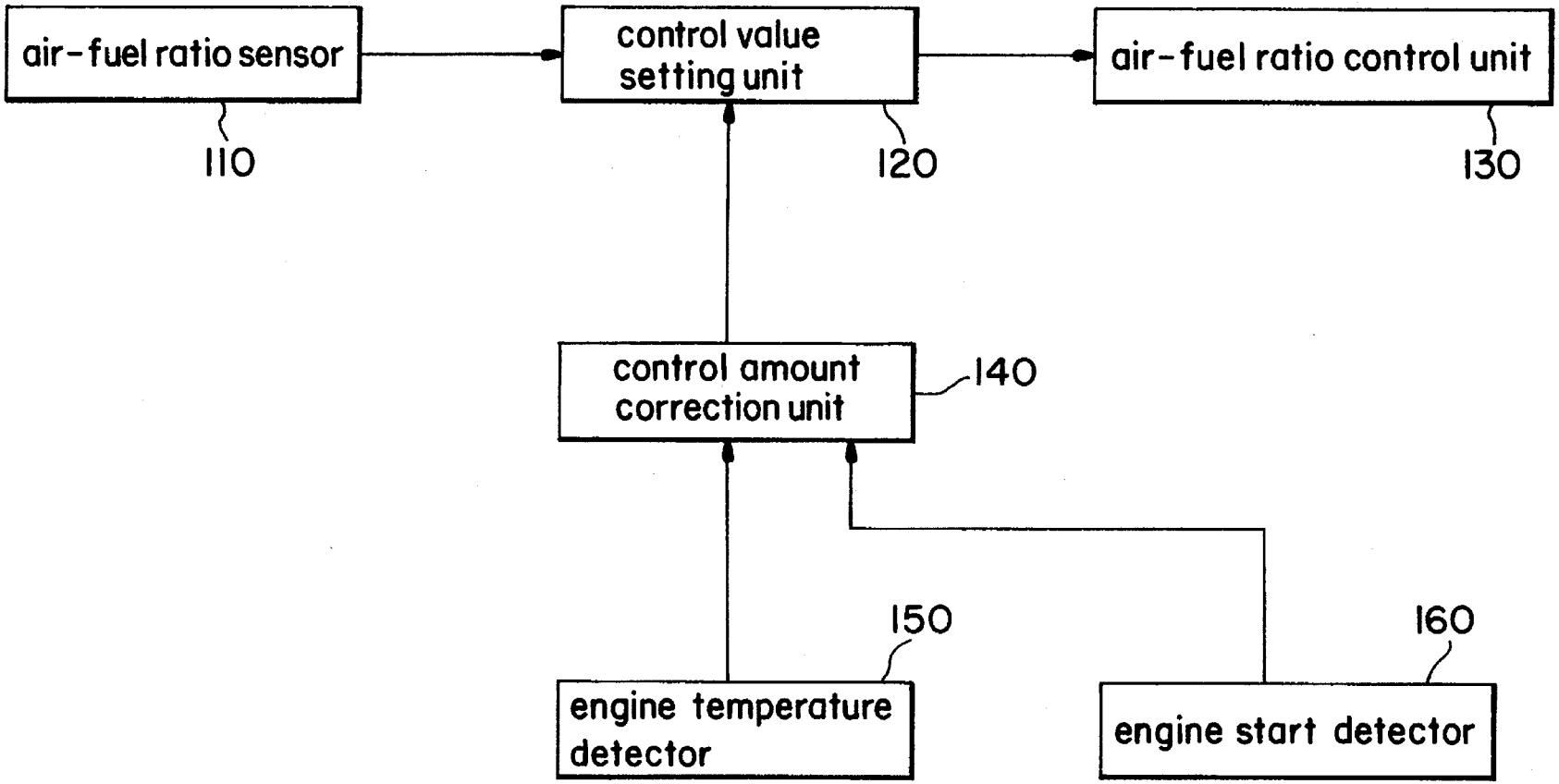
FIG. 1 is a block diagram of a preferred embodiment of the invention.

FIG. 1 illustrates, in block diagram form, an air-fuel ratio control apparatus for an internal combustion engine according to a preferred embodiment of the invention.

In the FIG. 1 embodiment, an air-fuel ratio sensor 110 produces an output which varies with the density of a specific component in the exhaust gas that changes in accordance with the air-fuel ratio of the engine intake mixture. A control value setting unit 120 sets a control value to feedback-control the air-fuel ratio of the engine intake mixture to a target air-fuel ratio. An air-fuel ratio control unit 130 controls the air-fuel ratio of the engine intake mixture based on the control value set by the control value setting unit 120. An engine temperature detector 150 detects the engine temperature and an engine start detector 160 detects the engine operating condition.

A control amount correction unit 140 corrects the control value set by the control value setting unit 120 using the engine temperature detected by the engine temperature detector 150 and the time elapsed since engine start as detected by the engine start detector 160. The air-fuel ratio sensor 110 is provided with a heater to heat the sensor element. The heater is turned on in synchronization with ignition switch operation. The engine start detector 160 preferably detects switching on the ignition switch as engine starting.

In this system, a control value is set for feedback-controlling the actual air-fuel ratio to a target air-fuel ratio based on the detected air-fuel ratio. The control amount used to set the control value is corrected for engine temperature and the time that has elapsed since engine start. These later two parameters are representative of the activation state of the air-fuel ratio sensor 110. The characteristics for air-fuel ratio feedback control are thus modified in accordance with the temperature condition of the air-fuel ratio sensor by detection of engine temperature and engine starting.

Figure 2:
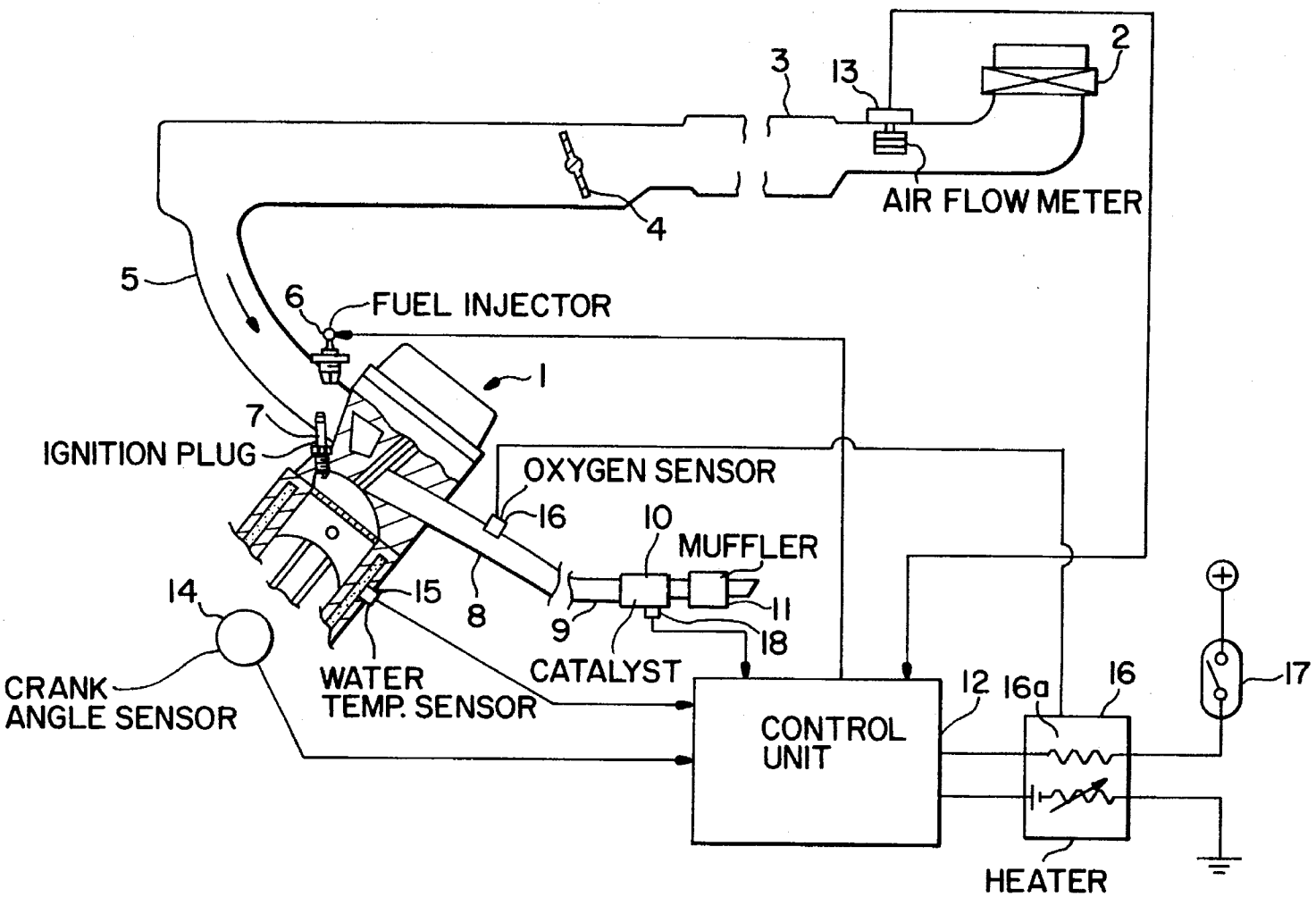
FIG. 2 is a more detailed system diagram for the preferred embodiment shown in FIG. 1.

FIG. 2 illustrates a more detailed system diagram for the embodiment of FIG. 1. As illustrated in FIG. 2, air is inducted into an internal combustion engine 1 via an air cleaner 2, an intake duct 3, a throttle valve 4, and an intake manifold 5. A fuel injector 6 is disposed in each branch of the intake manifold 5. Each fuel injector 6 is an electromagnetically operated fuel injector which is opened by an electric driving pulse from a control unit 12, described in further detail below, and provides the engine 1 with fuel which has been pressurized by a fuel pump (not shown) and adjusted to the appropriate pressure by a pressure regulator (not shown).

An ignition plug 7 is disposed in each combustion chamber of engine 1 to ignite and burn the air-fuel mixture. Exhaust gases are emitted from the engine 1 through an exhaust manifold 8, an exhaust duct 9, a three-way catalyst 10, and a muffler 11. The control unit 12 is provided with a microcomputer which includes a CPU, a ROM, a RAM, an A/D (analog-to-digital) transducer and an I/O (input/output) interface. The control unit 12 receives input signals from various sensors and sets a fuel injection amount for fuel injector 6 based on calculations, to be described below, to control the opening of fuel injector 6.

An air flow meter 13 is disposed in the intake duct 3 and provides a signal indicating the engine intake air flow amount Q. A crank angle sensor 14 provides a signal indicative of crank angle. In the case of a four cylinder engine as in this embodiment, the crank angle sensor 14 provides a reference signal REF for each 180 degrees of crank angle and a unit signal POS for each 1 degree or each 2 degrees of crank angle. Engine revolution speed N is determined by measuring the frequency of the reference signal REF or the occurrence of the unit signal POS.

A water temperature sensor 15 is provided as an engine temperature detector. Sensor 15 detects the water temperature Tw of the water jacket of the engine, which is representative of the engine temperature. An oxygen sensor 16 is disposed in a convergent portion of exhaust manifold 8 and serves as an air-fuel ratio sensor. The output of sensor 16 varies with the oxygen density of the exhaust gas, which is representative of the air-fuel ratio of the engine intake mixture. The oxygen sensor 16, shown as an equivalent circuit in FIG. 2, is a type of battery which generates an electromotive force in response to the oxygen density ratio of the oxygen density in the exhaust gases to the oxygen density in the atmosphere. In this embodiment, the oxygen sensor 16 includes a heater 16*a* to heat the sensor element attached thereto. Power is supplied to heater 16*a* through an ignition switch 17, which serves as an engine start detector. Catalyst temperature sensor 18 provides a catalyst temperature signal to control unit 12, which generates a warning signal if the catalyst temperature is too high.

Figure 3:
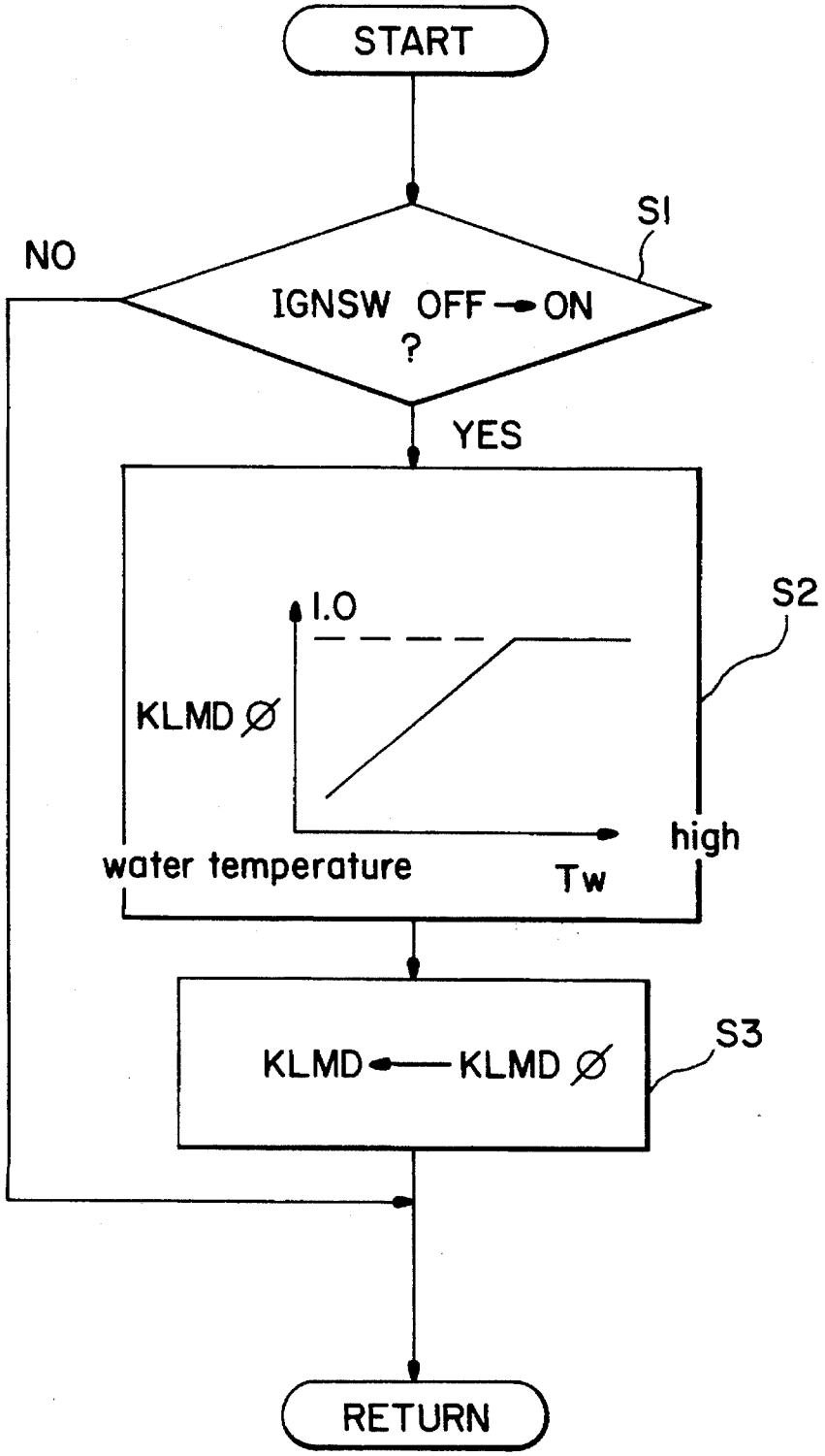
FIG. 3 is a flowchart illustrating a process for setting an initial value of a control amount correction value.
Figure 4:
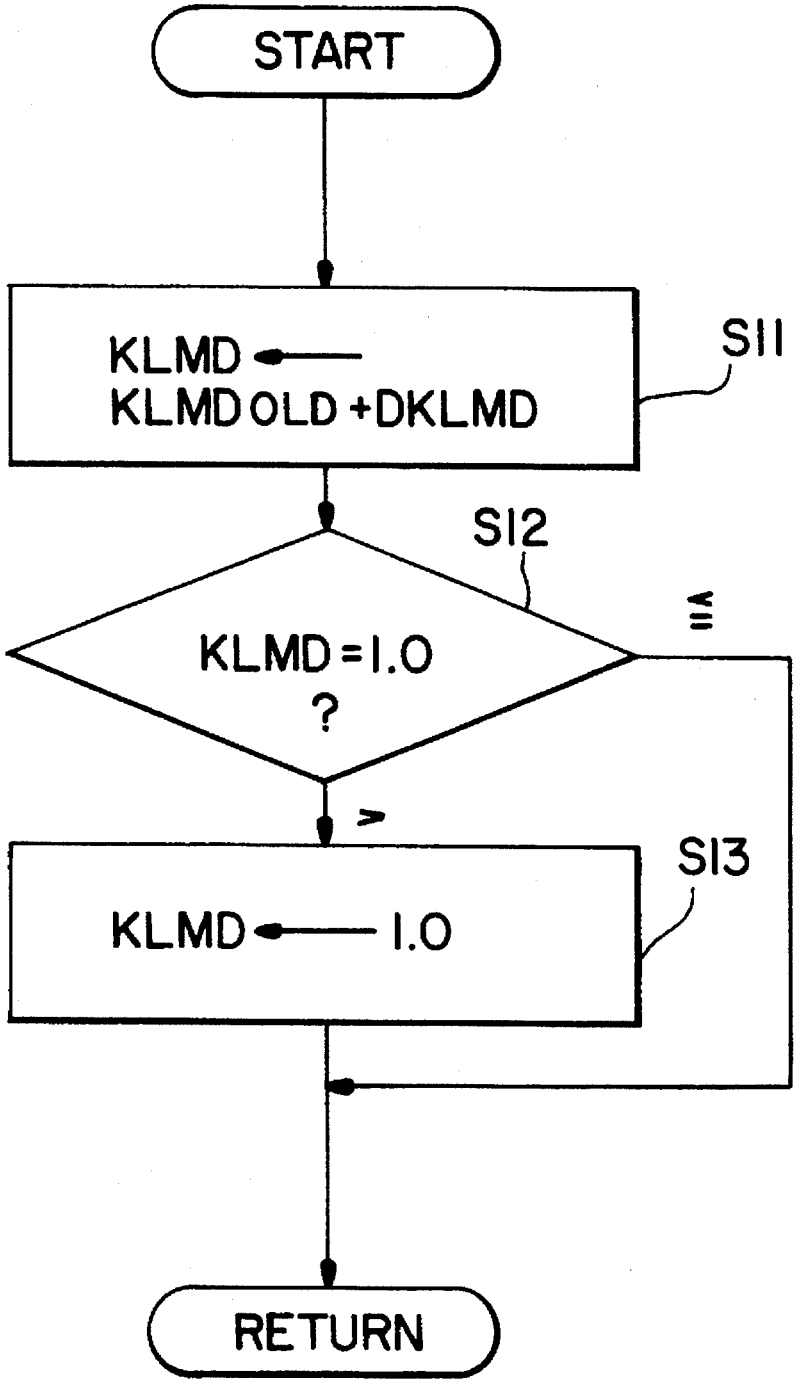
FIG. 4 is a flowchart illustrating a process for setting a control amount correction value based on elapsed time.
Figure 5:
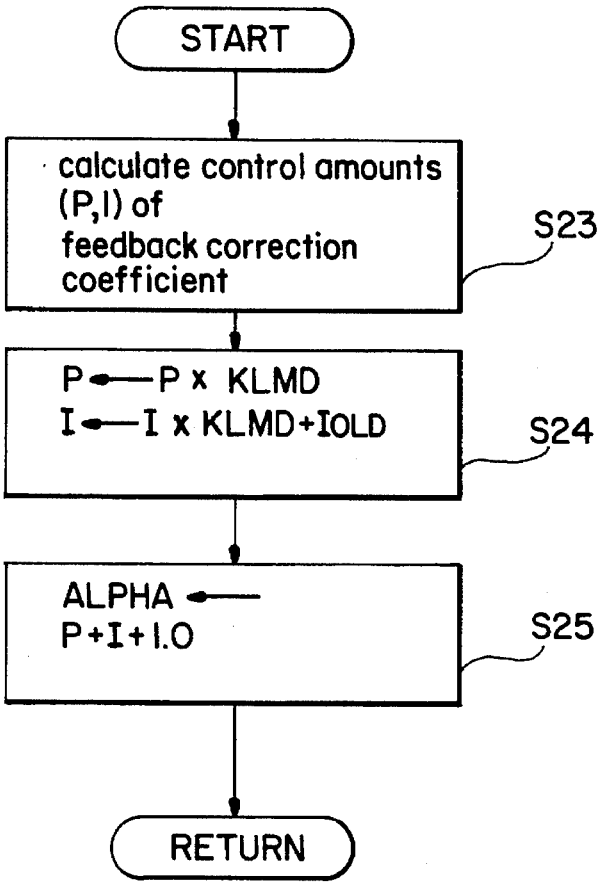
FIG. 5 is a flowchart illustrating a process for setting a feedback control value.

The CPU of the microcomputer housed in control unit 12 performs calculations in accordance with a program stored in the ROM, as illustrated in the flowcharts of FIGS. 3, 4, and 5, and sets an air-fuel ratio feedback correction coefficient ALPHA as a control value for feedback-controlling the air-fuel ratio of the engine intake mixture to a target air-fuel ratio.

The CPU corrects a basic fuel injection amount based on the feedback correction coefficient ALPHA to set a final fuel injection amount Ti and controls the injection amount using feedback to make the air-fuel ratio of the engine intake mixture equal to the target air-fuel ratio. In the present embodiment, control unit 12 includes the control value setting unit 120, the air-fuel ratio control unit 130, the control amount correction unit 140, and the engine start detector 160. These components operate in accordance with the processes illustrated in FIGS. 3, 4, and 5.

The process shown in the flowchart of FIG. 3 sets an initial value KLMDø of a correction value KLMD for correcting the air-fuel ratio feedback correction coefficient ALPHA based on the engine water temperature at the time that the engine is started. First, step S1 determines whether the ignition switch has been switched from off to on. When the ignition switch is on, processing proceeds to step S2. In step S2, an initial value KLMDø corresponding to the water temperature Tw at the time the ignition switch is switched on is determined using a map which stores the initial value KLMDø corresponding to the water temperature Tw. This initial value KLMDø is set to 1.0 when no substantial correction is required and to less than 1.0 at low water temperatures. In step S3 the initial value KLMDø is set as the correction value KLMD.

The process shown in the flowchart of FIG. 4 aims at gradually converging the above initially set correction value KLMD to 1.0 in accordance with the time elapsed from the engine start, i.e., from the time that the ignition switch is switched on. First, in step S11, a fixed value DKLMD is added to a previous correction value KLMDold, and the result of this addition is set as the new correction value KLMD. In step S12, it is determined whether or not the correction value KLMD exceeds 1.0 as a result of this addition. When the correction value KLMD exceeds 1.0, the processing proceeds to step S13 wherein the correction value KLMD is set to 1.0 so that a value exceeding 1.0 is not used as the correction value. On the other hand, when the correction value KLMD does not exceed 1.0, the processing proceeds back to step S11. In this way, over time the correction value KLMD is gradually converged to 1.0 from the initial value corresponding to the water temperature Tw at the point the ignition switch was turned on.

Since the heater 16*a* of oxygen sensor 16 is turned on when the ignition switch is turned on, the elapsed time from ignition turn-on corresponds to the heater operating time. As described above, the correction value KLMD is processed to converge from the initial value, corresponding to the water temperature at the point of ignition switch turn-on, to 1.0.

The correction value KLMD is used for proportional and integral control using the air-fuel ratio feedback control correction coefficient ALPHA as illustrated in FIG. 5. In step S23 in FIG. 5, control amounts for a proportional portion P and an integral portion I are set by comparing a reference level equivalent to a target air-fuel ratio with the output of oxygen sensor 16. In the next step S24, a final proportional portion P is set by multiplying the proportional portion P by the correction value KLMD and a final integral portion I is set by adding the previous integral portion Iold to the value resulting from multiplying the integral portion I by the correction value KLMD.

In step S25, the correction coefficient ALPHA is set to control the actual air-fuel ratio to the target air-fuel ratio using feedback by adding the proportional portion P and the integral portion I to the reference value 1.0 of the correction coefficient. The correction coefficient ALPHA is in turn multiplied by a basic fuel injection amount which is calculated based upon intake air flow Q, detected by airflow meter 13, and engine revolution speed N, which thus results in obtaining the target air-fuel ratio through feedback control of the fuel injection amount. The correction value KLMD corrects the proportional portion P and the integral portion I, i.e., the control amount, via proportional and integral control of the correction coefficient ALPHA, i.e., the air-fuel ratio control value. KLMD varies with the elapsed time from an initial value, corresponding to the engine temperature at engine starting, and converges to the reference value 1.0, requiring no substantial correction, and is set at a value less than 1.0 when the engine temperature at the time of engine starting is low. The engine start point does not correspond to initiation of engine cranking but instead corresponds to turning on heater **16*a*. The correction value KLMD reflects the temperature condition of the oxygen sensor 16** which in turn influences the sensor's degree of activation.

In summary, at lower temperatures where the oxygen sensor is less active, the control amount of the correction coefficient ALPHA is decreased. When the temperature of oxygen sensor 16 is low during an engine cold start, and the heat of heater **16*a* is not yet sufficient (which means that the response of the oxygen sensor 16 is poor) the control amount of the correction coefficient ALPHA is set at a smaller value as compared with its value at a warm condition. This prevents controlling the air-fuel ratio by an excessively large amount that is based on a correction coefficient calculated when the response of the oxygen sensor 16** is poor. As a result, the actual air-fuel ratio is stably controlled within a narrow range around a target air-fuel ratio, i.e., the theoretical air-fuel ratio, which in turn promotes driveability and improves exhaust emissions control by the catalyst.

Figure 6:
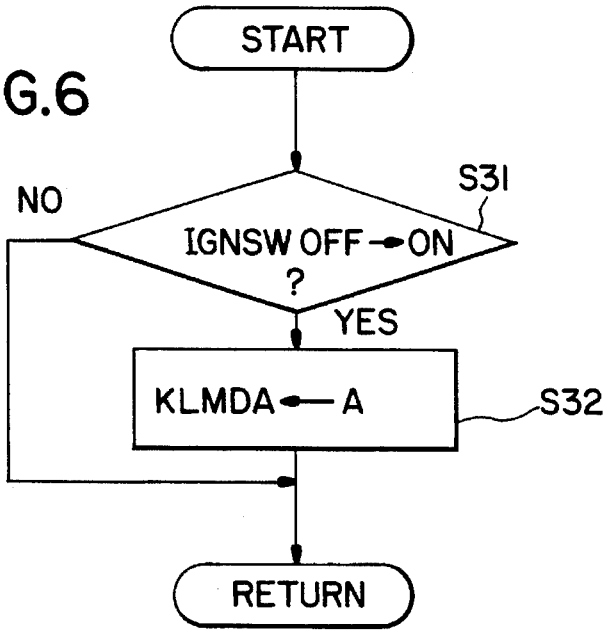
FIG. 6 is a flowchart illustrating an alternative process for setting an initial value of a control amount correction value.
Figure 7:
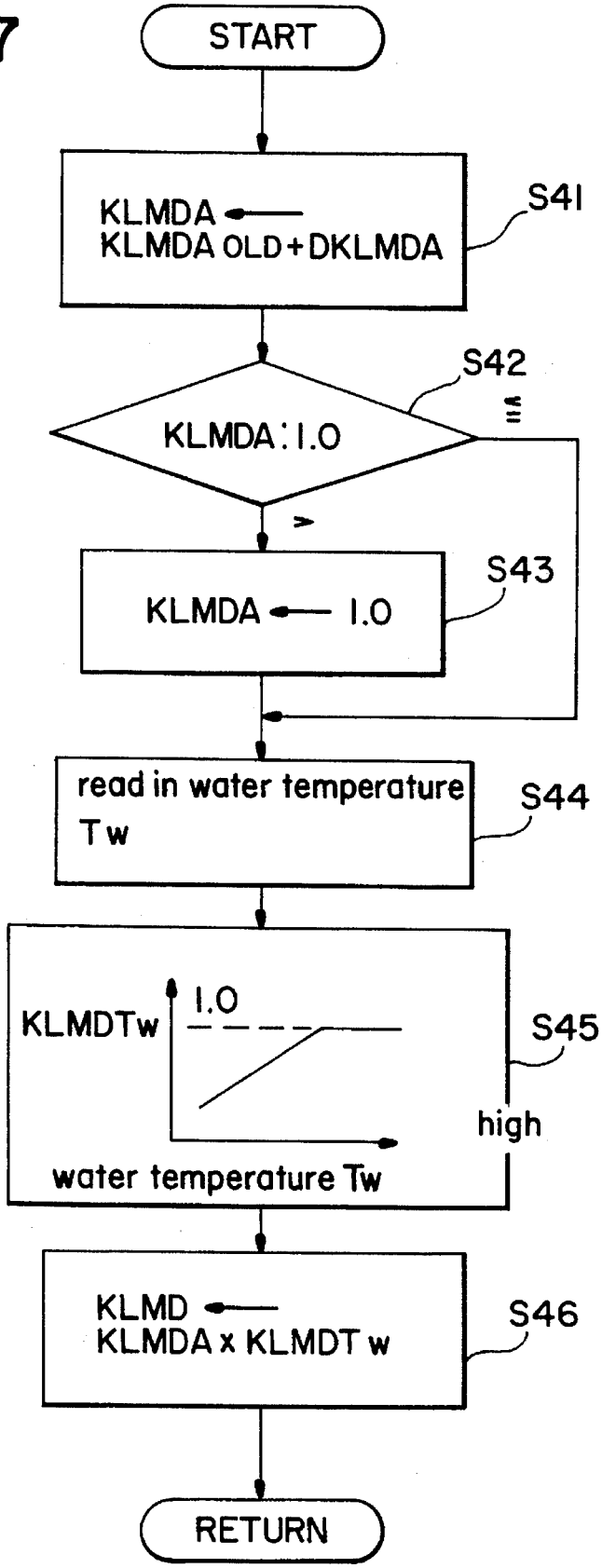
FIG. 7 is a flowchart illustrating a process for correcting the control amount correction value for engine water temperature.

In the embodiment described above, engine water temperature is used as an indication of engine temperature to set an initial value. The flowcharts of FIGS. 6 and 7 illustrate another embodiment in which a correction value KLMDA having a fixed value A as an initial value gradually increases to 1.0 in accordance with the time elapsed from engine ignition. The correction value KLMDA is also corrected in accordance with the current temperature Tw.

In FIG. 6, in step S31, it is ascertained whether the ignition switch is on. If the ignition switch is on, the processing proceeds to step S32 wherein the correction value is set to a fixed value A. In FIG. 7, in step S41, a fixed value DKLMDA is added to correction value KLMDAold to thus be increased according to the elapsed time and the addition result is set to be the new correction value. In the next step S42, it is determined whether or not the new correction value KLMDA of step S41 exceeds 1.0. When the correction value KLMDA exceeds 1.0, the correction value KLMDA is set to 1.0 in step S43, and the processing proceeds to step S44. When the correction value does not exceed 1.0, the processing proceeds directly to step S44, skipping step S43.

In step S44, the water temperature Tw that is detected by water temperature sensor 15 is read. In the next step S45, a correction value KLMDTw for correcting the above correction value KLMDA in accordance with water temperature Tw is set based on the water temperature Tw read in step S44. The correction value KLMDTw is set at 1.0 when Tw is high and at less than 1.0 when Tw is low. Thus, at a cold state, the correction value KLMDA is decreased. In step S46, the correction value KLMDA (set according to the elapsed time) is corrected by the correction value KLMDTw (set according to water temperature Tw) and the correction result thereof is set as the correction value KLMD to correct the control amount of the feedback correction coefficient. The correction value KLMDA is thus set to correspond to the activation state of the oxygen sensor using heater **16*a* when the engine starts from a normal temperature state. Variation in the temperature of the oxygen sensor 16** is corrected using the correction value KLMDTw when the temperature of the oxygen sensor is lower than its normal operating temperature.

The above correction value KLMD, calculated as described above with reference to FIGS. 6 and 7, is used as shown in FIG. 5 to correct the proportional portion and the integral portion for proportional and integral control of the air-fuel ratio feedback correction coefficient ALPHA.

The embodiments illustrate air-fuel ratio feedback correction control using proportional and integral control. However, air-fuel ratio feedback correction control can be accomplished by integral control only, or by proportional, integral and differential control. In the above embodiments, the oxygen sensor 16 is the type of sensor which generates electromotive force in response to the oxygen density ratio. However, the oxygen sensor can be the type whose resistance value varies in response to the oxygen density ratio.

As will be apparent from the description set forth above, the instant invention is a significant improvement over conventional systems because excessively large amplitude variation in the air-fuel ratio control signal due to poor oxygen sensor response is avoided. As a result, the air-fuel ratio at the time of engine starting is stable around the target air-fuel ratio, which in turn promotes improvements in exhaust emission control and driveability.

Although the invention has been described above with reference to certain specific embodiments, the scope of the invention is not limited to the embodiments described above. Other designs, modifications and variations within the spirit and scope of the invention will be apparent to those skilled in the art after receiving the above teachings. The scope of the invention, therefore, is defined with reference to the following claims.

What is claimed is:

1. A process for controlling an air-fuel ratio in an internal combustion engine, comprising the steps of:

(a) producing an air-fuel ratio signal representative of an actual air-fuel ratio in said engine using a sensor having temperature-variant output characteristics;

(b) detecting a current temperature of said engine and producing an engine temperature signal which varies in accordance with said current temperature of said engine;

(c) detecting a starting of said engine and producing an elapsed time signal representative of a time elapsed since said starting of said engine;

(d) compensating said air-fuel ratio signal for said temperature-variant output characteristics in accordance with said engine temperature signal and said elapsed time signal to produce a compensated air-fuel ratio signal; and (e) supplying said compensated air-fuel ratio signal to an assembly that varies an amount of fuel delivered to said engine, wherein said temperature-variant output characteristics are determined by a correction value having a fixed initial value which then gradually increases to 1.0 in accordance with the time elapsed from engine starting.

2. A process for controlling an air-fuel ratio in an internal combustion engine, comprising the steps of:

(a) producing an air-fuel ratio signal representative of an actual air-fuel ratio in said engine using a sensor having temperature-variant output characteristics;

(b) detecting a current temperature of said engine and producing an engine temperature signal which varies in accordance with said current temperature of said engine;

(c) detecting a starting of said engine and producing an elapsed time signal representative of a time elapsed since said starting of said engine;

(d) compensating said air-fuel ratio signal for said temperature-variant output characteristics in accordance with said engine temperature signal and said elapsed time signal to produce a compensated air-fuel ratio signal; and (e) supplying said compensated air-fuel ratio signal to an assembly that varies an amount of fuel delivered to said engine, wherein said temperature-variant output characteristics are determined by a correction value KLMDA having a fixed initial value which then gradually increases to 1.0 in accordance with the time elapsed from engine starting.

3. A process for controlling an air-fuel ratio in an internal combustion engine as set forth in claim 2, wherein said correction value KLMDA is corrected using a map to generate a correction value KLMDTw corresponding to engine water temperature Tw.

4. A process for controlling an air-fuel ratio in an internal combustion engine as set forth in claim 2, wherein said correction value is corrected using a map to generate a second correction value corresponding to engine water temperature.

* * * * *